US005924408A

United States Patent [19]

van den Wildenberg

[11] Patent Number: 5,924,408

[45] Date of Patent: Jul. 20, 1999

[54] FUEL METERING SYSTEM FOR SEQUENTIALLY FEEDING FUEL TO THE CYLINDERS OF A COMBUSTION ENGINE

[76] Inventor: Adrianus Martinus Maria van den Wildenberg, Beekstraat 39 E, Nuenen, Netherlands, 5673-NA

[21] Appl. No.: 08/836,532

[22] PCT Filed: Oct. 31, 1995

[86] PCT No.: PCT/NL95/00374

§ 371 Date: Jul. 14, 1997

§ 102(e) Date: Jul. 14, 1997

[87] PCT Pub. No.: WO96/13659

PCT Pub. Date: May 9, 1996

[30] Foreign Application Priority Data

Oct. 31, 1994 [NL] Netherlands ..... 940187

[51] Int. Cl.[6] ..... F02M 41/16

[52] U.S. Cl. ..... 123/450; 123/448; 123/445

[58] Field of Search ..... 123/448, 450, 123/506, 514

[56] References Cited

U.S. PATENT DOCUMENTS 2,955,583 10/1960 Dahl et al. ..... 123/450
4,184,465 1/1980 Nakazeki et al. .
4,200,074 4/1980 Kosuda et al. ..... 123/450

FOREIGN PATENT DOCUMENTS

A 0 361 199 4/1990 European Pat. Off. .
A 29 21 766 12/1980 Germany .
A 36 18 447 12/1987 Germany .
WO A 94 05908 3/1994 WIPO .

*Primary Examiner*—Thomas N. Moulis
*Attorney, Agent, or Firm*—Pennie & Edmonds LLP

[57] ABSTRACT

Fuel metering system for feeding fuel from a storage tank (2) to the cylinders (6) of a combustion engine (8), comprising a fuel supply unit (1) and a distributing device (4, 4', 4") which comprises a least one rotor driven depending on the rotational position of a crankshaft (16) or camshaft of the combustion engine (8), with the fuel supply unit supplying fuel from the storage tank (2) to the distributing device (4, 4', 4") and with the distributing device (4, 4', 4"), depending on the rotational position of the rotor, sequentially feeding fuel to the cylinders (6) of the combustion engine. The fuel supply unit (1) continuously supplies fuel to the distributing device (4, 4', 4"). The rotor (13) is driven continuously, with the angle of rotation of the rotor (13) being a continuous function of the angle of rotation of the crankshaft (16) or camshaft.

18 Claims, 8 Drawing Sheets

FUEL METERING SYSTEM FOR SEQUENTIALLY FEEDING FUEL TO THE CYLINDERS OF A COMBUSTION ENGINE

BACKGROUND OF THE INVENTION

The invention relates to a fuel metering system for feeding fuel from a storage tank to the cylinders of a combustion engine, comprising a fuel supply unit and a distributing device comprising at least one rotor, with the fuel supply unit continuously supplying fuel from the storage tank to the distributing device, and with the distributing device, depending on the angle of rotation of the rotor, sequentially feeding fuel to the cylinders of the combustion engine while determining for each cylinder during what period fuel is injected at the cylinder.

Such a system is known from, for instance, German Offenlegungsschrift 2921766. According to the German Offenlegungsschrift, the object contemplated is to provide a system in which the use of electromagnetic (on/off) injectors is avoided. This is realized by a rotor/stator combination, with the rotor being driven by a stepping motor. The angular displacement of the rotor is here time-controlled. The rotor is triggered by a reference on, for instance, a camshaft. After being triggered, the rotor rotates through a predetermined angle under the control of the stepping motor, wholly independently of the crankshaft and camshaft. Thereafter the rotor is stationary for a predetermined period. The period during which the rotor is stationary in an open position is dependent on the load of the engine and not directly on the speed of the engine, i.e., independent of the speed of rotation of the crankshaft and camshaft and hence independent of the instantaneous angle of rotation of the crankshaft and camshaft. During the period when the rotor stands still, fuel is fed to one of the cylinders, or fuel is fed to none of the cylinders. Here, as with systems in which injectors are used with a pulse width control, the fuel supply is switched on and off, respectively, under time control. Such a control of the fuel flow by variation of the open and/or closed time of a rotating valve with a discrete number of stable angular positions, is in practice difficult to realize, if at all. Stepping motors have a limited speed and therefore are generally not suited for such a control. The rotor/stator combination needs time to rotate through the closed position. The longer the mechanical valve (at a particular speed of the engine and the rotor) is in the open position, the more time to move through the closed position is lost. Conversely, the maximum time left for the open position is the time of the period minus the minimum closed time.

Further, the known rotor/stator combination involves a minimum open time: the time needed to move through the open position as fast as possible. That is also a disadvantage of that mechanical metering device over electromagnetic injectors, because the minimum pulse width thereof is zero. The control range of the known quantity control according to the Offenlegungsschrift is therefore by definition smaller than that of an electromagnetic one with pulse width control.

If several cylinders are provided with fuel by one mechanical distributor, an additional problem arises. The rotor rotates (in the case of a four-stroke engine) at half the crankshaft frequency. When the rotor must deliver fuel for all cylinders in one revolution, the frequency of the fuel pulses increases with the number of cylinders. The number of angular positions thereby increases proportionally to the number of cylinders. So at a given speed of the engine (and the rotor) the step time decreases proportionally. Or, at a given step time of the stepping motor, the maximum attainable speed of the rotor decreases proportionally.

The minimum open time is one stepping period. Without adjustments of the fuel pressure, this results in the minimum quantity of fuel being delivered even at zero load (no couple, so no fuel needed). If that quantity is made slight by reducing the passage, this in turn leads directly to unacceptable consequences for full load at high speeds. In that case the rotor cannot remain long in the opened position to deliver the required quantity of fuel because the available period and the time loss in the closed position do not allow this. Without additional measures, therefore, a mechanical metering and distributing device driven directly by a stepping motor cannot work. The control range is too small. Invariably, a certain minimum quantity of fuel is delivered, so that either too much fuel is metered at low engine loads or too little fuel is metered at high loads and high speeds. Moreover, the maximum attainable speed is limited by the stepping motor and the number of discrete angular positions.

According to the Offenlegungsschrift, the fuel flow can be increased by shifting the rotor, in such a manner that the rotor partly clears a number of outlets of the stator. In that case, fuel flows continuously to these outlets and continuous injection is involved.

Summarizing, it can be stated that the system according to the German Offenlegungsschrift entails the following problems:

- The rotor position is not instantaneously dependent on the angle of rotation of the crankshaft or camshaft. This has as a disadvantage that injection within a certain angle of the crankshaft or camshaft is not guaranteed.
- The relation between the rotor position and the crankshaft position is discontinuous. The rotor has a fixed and limited number of angular positions. The transmission ratio is therefore a "stepped function". The consequence is that the control range in angular positions is zero, while the resolving power is also zero.
- The only variable that is available is time. The control range in time is considerably limited by the stepping motor, in that all cylinders are provided with fuel by one rotor and by the fact that many closed positions are present.
- The system cannot work correctly under all operating conditions of a combustion engine.

SUMMARY OF THE INVENTION

The object of the invention is to provide a system with a continuous sequential injection, which does not entail the above-mentioned practical disadvantages. The system according to the invention is characterized in that the fuel metering system comprises drive means for driving the rotor in a continuously rotating manner, with the angle of rotation of the rotor being a continuous function of the instantaneous angle of rotation of a crankshaft or camshaft of the combustion engine, and with the distributing device continuously sequentially feeding fuel to the cylinders of the combustion engine.

In the system according to the invention, the rotor is driven in a continuously rotating manner, with the angle of rotation of the rotor being controlled not as a function of time but according to a continuous function of the instantaneous angle of the crankshaft or camshaft. The resultant achievement is that the control range of the distributing device is increased. Also, a high resolving power is realized. In addition, the injection within a predetermined crankshaft or camshaft angle is always guaranteed The open and/or closed time can be directly dependent on the speed of the engine. Driving the rotor in a continuously rotating manner also implies an increase of the control range of the system and the possible speed of the engine. Thus a further achievement is that electromagnetic (on/off) injectors need not be used in the system.

Preferably, the rotor, in use, allows fuel to flow within the opening angle of an inlet valve of a cylinder through the distributing device to the cylinder in question. This means that fuel is fed to the cylinder within the opening angle of the inlet valve of that cylinder. In the German Offenlegungsschrift, by contrast, a pulse width modulation is described, having as primary metering variable the open time of a rotor/stator combination without any relation to the opening of the inlet valves.

In particular, each change of the angle of rotation of the crankshaft or camshaft corresponds with a change of the angle of rotation of the rotor. This means that the rotor, with an engine running, will never stand still and therefore can be driven in a simple manner. According to a particular embodiment of the system according to the invention, the rotor is accordingly connected mechanically with the crankshaft of the engine. Thus a system is obtained which is not only particularly reliable, but also can be manufactured in an economically highly advantageous manner.

The fuel flow must be determined by the load. So, at zero load no fuel may be delivered, in spite of the fact that the distributing device opens.

According to an advanced embodiment of the fuel metering system, the system accordingly further comprises at least one controllable flow resistance element located downstream of the fuel supply unit, for controlling the magnitude of the fuel flow to the cylinders. In particular, a control unit of the metering system controls the flow resistance element depending on the engine parameters, such as for instance the engine load and/or the rotary movement of the crankshaft. According to the German offenlegungsschrift, it is only known to employ as a secondary control parameter—and hence only for special conditions, such as deceleration, acceleration and cold start/heat-up—a temporary pressure change in the fuel metering system.

The continuous sequential feed of fuel by means of a distributing device is known, for instance, from European patent application EP 0361199. This publication describes a fuel metering system with an assembly of an electromagnetic metering valve and a distributing valve, which system chiefly pertains to the supply of liquid fuels. By means of a pump, fuel is led from a fuel tank to a metering valve which, depending on the speed of revolution of the crankshaft and on engine parameters, such as the crankshaft angle, speed, throttle valve position, temperatures, etc., provides a distributing chamber of the distributing valve with fuel in a metered and discontinuous manner. The distributing valve is driven by means of a synchronous motor and distributes the metered fuel over the different cylinders of the combustion engine. The synchronous motor is coupled to the speed of revolution of the crankshaft. The periods where fuel is supplied to the cylinders is therefore determined by the opening time and the open-closed frequency of the metering valve and not by the distributing device. The distributing device only divides the supply of fuel over the different cylinders.

This fuel metering system, however, has the disadvantage that the assembly of the metering and distributing valves is laborious in construction and entails considerable costs in incorporating such fuel metering system. Moreover, the electromagnetic metering valve and the associated control are sensitive to malfunction. Also, the electromagnetic metering valve is less suitable for gaseous fuels. Compared with a liquid fuel, a gaseous fuel possesses a relatively low energy density per unit volume, so that for the same mass or energy flow a much higher volume flow must be delivered, which means for the electromagnetic metering valve that either the diameter of the core and the stroke of the core or the pressure to be offered must be increased. Both alternatives, however, are bound to limits and cannot be simply realized by means of conventional metering valves.

In accordance with the invention, fuel is fed to the distributing device continuously, in contrast to what is the case in the system according to European patent application EP 0362199. This means that the distributing device not only determines at what cylinder fuel is injected, but also determines during what angle of rotation of the crankshaft and/or camshaft fuel is injected for the benefit of the cylinder in question. The period during which the fuel is injected for the purpose of a cylinder is determined, according to the European patent application, by the electromagnetic metering valve and injection valves, which are arranged adjacent cylinders and do not open until the shut-off valve is sufficiently opened, in order that via the distributor a sufficiently high pressure is produced at an injection valve.

International patent application WO-A-94/05908 also discloses a fuel metering system in which use is made of injection valves. Here too, fuel is supplied to the distributor by means of a pump. The distributor, which also comprises a rotor, determines, depending on the angle of rotation of the rotor, to which injector fuel is fed. Arranged parallel to the pump is a shut-off valve which can be opened, so that fuel which is being pumped from a tank by the pump can flow back to the tank via the shut-off valve. In that case no fuel is fed to the distributor. Accordingly, the system involved here is a system where the fuel is not fed continuously to the distributor. Not the distributor but the shut-off valve determines the period over which fuel is fed to a cylinder of the engine.

Through the features of the invention, a fuel metering system is provided having a number of surprising advantages over the known prior art, which is suitable not only for liquid fuels, but in particular also for gaseous fuels.

In a particular embodiment of the fuel metering system, the system distributes and meters the fuel depending on the speed of revolution of the crankshaft and/or camshaft. An adjustment of the fuel flow to the load of the engine then occurs through a change of pressure via the fuel supply unit.

In another particular embodiment of a fuel metering system according to the invention, the system comprises the above-mentioned at least one flow resistance element. This may for instance be a throttle valve, which is arranged in the system either separately or integrated into the distributing device. A change of the fuel flow then occurs via the flow resistance element and/or the fuel supply unit. A fuel metering system which is particularly simple and inexpensive to produce is then obtained when the flow resistance element is connected directly, for instance mechanically, with a throttle valve for the combustion air of the engine, and the rotor of the distributing device is coupled directly to the crankshaft of the combustion engine.

In a particular embodiment of the fuel metering system according to the invention, the change of the fuel flow is realized by a dynamic variation of the speed of revolution of the rotor, which in combination with pressure control and/or fuel throughflow control by means of at least one flow resistance element provides the advantage of a particularly large control range.

BRIEF DESCRIPTION OF THE DRAWINGS

The invention will be further explained hereinafter on the basis of a number of exemplary embodiments, with reference to the drawings, wherein.

DETAILED DESCRIPTION OF THE INVENTION

Figure 1:
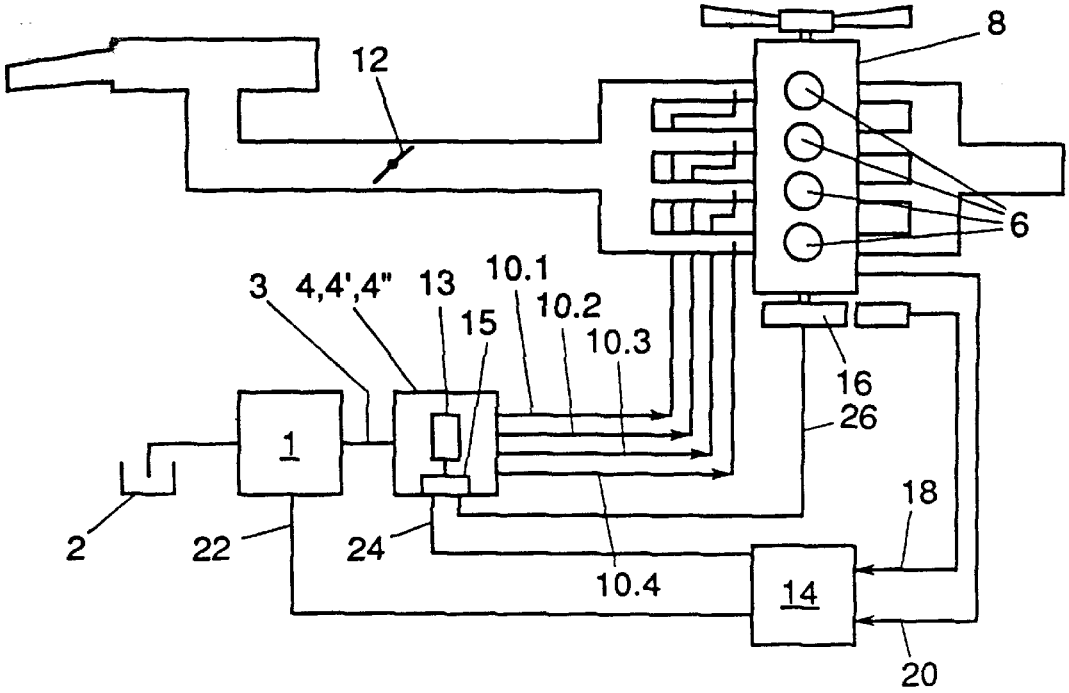
FIG. 1 shows a diagrammatic representation of an embodiment of a fuel metering system according to the present invention.

In the drawings, like parts are denoted by the same reference numerals. FIG. 1 diagrammatically shows an exemplary embodiment of a fuel metering system according to the invention. The system comprises a fuel supply unit 1 by means of which fuel is supplied from a tank 2 via, respectively, a line 3 and distributing device 4, 4', 4", to the inlet valves (not shown) of the cylinders 6 or directly into the cylinders of a combustion engine 8. The distributing device 4, 4', 4" distributes the fuel, being continuously fed by the fuel supply unit via line 3, over, in this example four, lines 10.1–10.4 for supply to the cylinders 6. In the case of liquid fuels, the fuel supply unit 1 consists, for instance, of a fuel pump. In the case of gaseous fuels, for instance a pressure control, hereinafter referred to as Fuel Pressure Control Unit (FPC), can be used. Because the fuel metering system according to the invention is suitable in particular for gaseous fuels, the assumption in the following description is that the fuel supply unit consists of an FPC. It is pointed out with emphasis that this is only an example of an embodiment, so that other designs of the fuel supply unit are conceivable.

Combustion air is supplied via a controllable resistance element, known per se, such as a throttle valve 12, to the cylinders 6 of the combustion engine 8. The distributing device 4, 4', 4" comprises at least one rotor 13, with the distributing device, depending on the angle of rotation of the rotor 13, sequentially feeding fuel to the cylinders 6. To that end, the system comprises driving means 15 for driving the rotor 13 in a continuously rotating manner. These driving means 15, which are shown only diagrammatically in FIG. 1, can for instance consist of a wheel which via a drive belt or line 26 is driven directly by a crankshaft 16 of the engine. It is also possible that the driving means consists of an electric motor which can rotate continuously. If desired, this electric motor can be temporarily stopped. In all cases, the rotor 13 is driven by the driving means 15 in such a manner that the angle of rotation of the rotor is a function of the instantaneous angle of rotation of the crankshaft 16 and/or the camshaft of the engine, in other words, the angle of rotation of the rotor is at any time dependent on the instantaneous angle of rotation of the crankshaft 16 of the engine. Hereinafter, crankshaft can also be read to mean camshaft and the other way around. It holds for all of the examples to be discussed hereinafter that the angle of rotation for the rotor is preferably a differentiatable function of the instantaneous angle of rotation of the crankshaft or camshaft of the engine. In any case, the angle of rotation of the rotor is a continuous function of the instantaneous angle of rotation of the crankshaft or camshaft. For controlling the distributing device 4, 4', 4", the driving means 15 and/or the fuel supply unit (FPC) 1, the system may further comprise a control unit 14, which is known per se under the name of Fuel Control Unit (FCU), and which controls the fuel supply unit 1 and/or the distributing device 4, 4', 4", for instance depending on the speed of revolution of the crankshaft 16 and/or the load of the combustion engine 8. To that end, the FCU 14 is provided in a manner known per se with information about, for instance, the speed of revolution of the crankshaft and the load on the engine, which is depicted diagrammatically by lines 18 and 20, respectively. Of course, other engine parameters, such as the temperature of the engine and a signal coming from a Lambda probe, can also be fed to the FCU 14 for the control of the fuel supply unit 1 and/or the distributing device 4, 4', 4". This information is processed by the FCU 14 for controlling, respectively, the FPC 1 and/or the distributing device 4, 4', 4", which is depicted diagrammatically by lines 22 and 24, respectively. However, the distributing device 4 can also be connected directly, for instance mechanically, to the crankshaft 16. This connection is represented diagrammatically by line 26.

Figure 2:
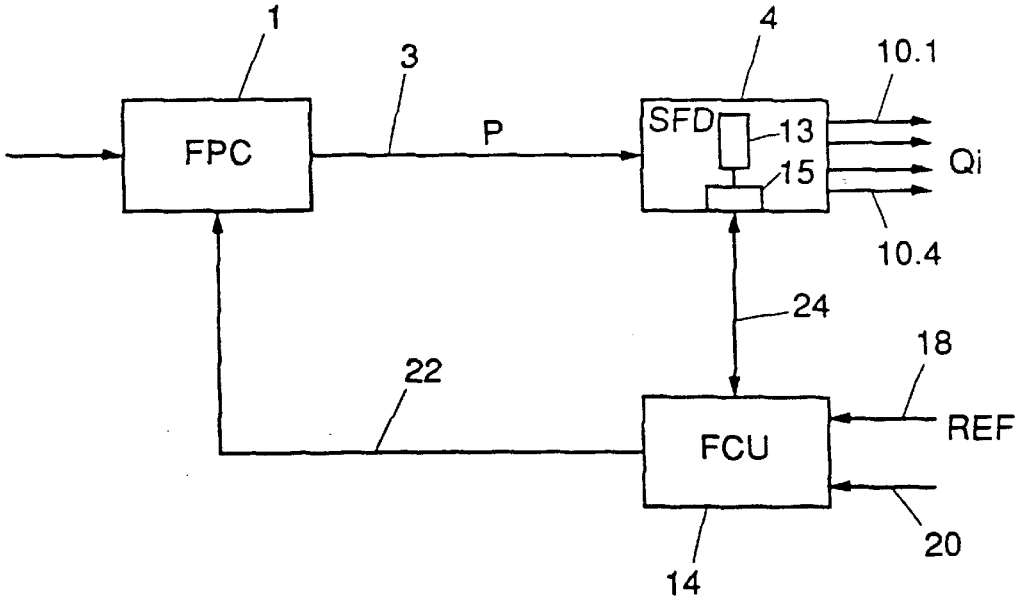
FIG. 2 shows a block diagram of a first particular embodiment of a fuel metering system according to the present invention with a sequentially operating distributing device.

FIG. 2 shows a block diagram for a first particular embodiment of the fuel metering system according to FIG. 1. The sequentially operating distributing device 4 is of a type where the distribution of the fuel supply over the lines 10.1–10.4 is coupled directly to the angle of rotation of the crankshaft 16 of the combustion engine 8. Such a distributing device 4 will hereinafter be designated as an SFD (Sequential Fuel Distributor). The rotor 13 of the SFD 4 is driven by the driving means 15 in angular synchronism with the crankshaft. One of the results is that every change in the angle of rotation of the rotor corresponds with a change in the angle of rotation of the crankshaft, so that the angle of rotation of the rotor is at any time dependent on the instantaneous angle of rotation of the crankshaft. In other words, the instantaneous angle of rotation of the rotor is a function of the instantaneous angle of rotation of the crankshaft.

The fact that the fuel metering system with the SFD 4 is driven by definition in angular synchronism with the process cycle of the combustion engine 8 means that the opening angle of the SFD 4, that is, the pulse width of the fuel supply, per cylinder 6 expressed in crankshaft degrees is constant. The opening time (pulse width) of the SFD 4 per cylinder 6 is therefore inversely proportional to the speed of the combustion engine 8. With increasing speed, the opening angle (in crankshaft degrees) remains constant, while the opening period of the SFD 4 decreases proportionally. The load of the combustion engine 8 thus has no influence on either the opening angle or the opening period of the SFD 4. Therefore, for a correct fuel metering as a function of the speed and the load of the combustion engine 8, one or more control parameters have to be inputted. Because the principle of the SFD 4 allows no variation of the opening angle and/or of the opening period, here a fuel flow Q flowing through the SFD 4 is chosen as control parameter. The fuel flow Q equals the sum of the fuel flows Qi through, respectively, the lines 10.i (i=1, 2, . . . n). Because the fuel flow Q depends on the pressure difference across the SFD 4 and the pressure in line 3, the flow resistance of the line 3 and the density of the fuel, these quantities can be varied for controlling the fuel flow Q. In the fuel metering system according to FIG. 2, the fuel pressure P is the only parameter which is varied for controlling the fuel flow. Here the SFD, in the case where it is not driven directly by the crankshaft 16 via line 26, is synchronized with respect to the crankshaft 16 by means of the FCU 14. To that end, via the lines 18 and 20, respectively, there are supplied to the FCU 14 an external reference angle signal and a signal representing the load of the combustion engine 8, so that the FCU 14 via the FPC 1 changes the fuel flow Q through an adjustment of the fuel pressure P. The FCU 14 can, for instance, be of a mechanical, electrical, pneumatic and/or hydraulic nature.

Figure 3:
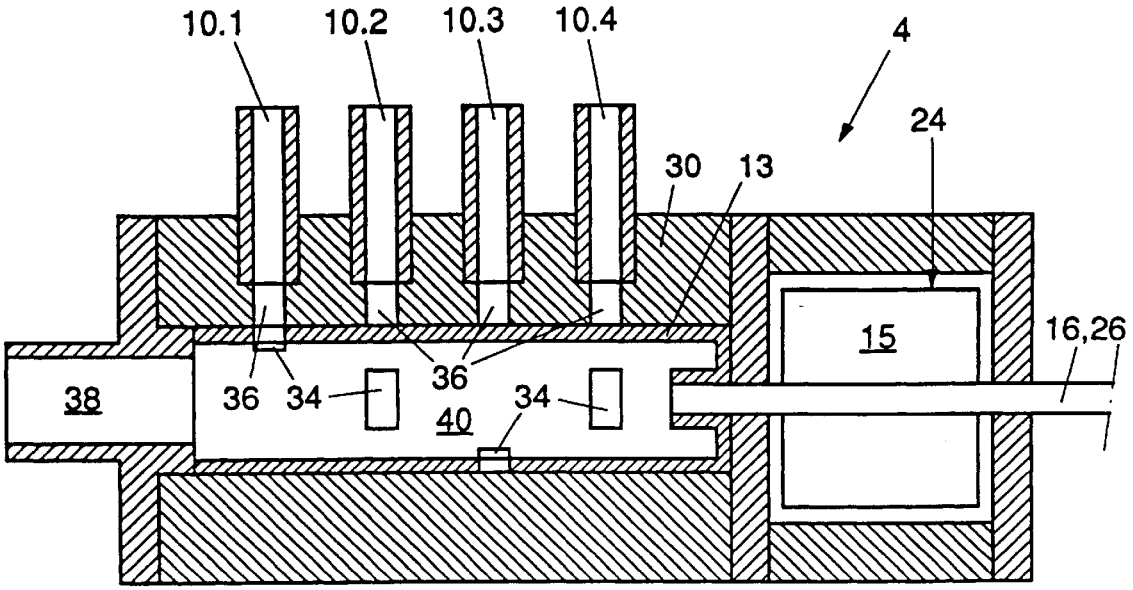
FIG. 3 shows a longitudinal cross section of a first embodiment of a distributing device suitable for use in the system according to FIG. 2.

FIG. 3 shows a first embodiment of the distributing device 4 which can be used as SFD in the system according to FIG. 2. This distributing device 4 comprises a rotor 13 bearing-mounted in a stator 30 and a drive mechanism 15 which, in the case where the rotor 13 is not linked directly to the crankshaft 16, drives the rotor 13 in a different manner, known per se, such as, for instance, mechanically, electrically, pneumatically or hydraulically. The rotor is driven in angular synchronism with the crankshaft. One of the results of this is that every change in the angle of rotation of the rotor corresponds with a change in the angle of rotation of the crankshaft, so that the angle of rotation of the rotor at any time depends on the instantaneous angle of rotation of the crankshaft. In other words, the instantaneous angle of rotation of the rotor is a function of the instantaneous angle of rotation of the crankshaft. The rotor 13 comprises outflow orifices 34 sequentially brought into throughflow communication with throughflow orifices 36 of the stator 30.

The fuel is fed continuously via a supply orifice 36 of the distributing device 4 to the interior 40 of the rotor 13. By means of the drive which is in angular synchronism with the crankshaft 16, the outflow orifices 34 of the rotor 13 are sequentially brought into communication with the corresponding throughflow orifices 36 of the stator 30, the arrangement being such that the fuel is fed sequentially via the lines 10.1–10.4 to the cylinders 6 of the combustion engine 8. Preferably, the throughflow orifices of the stator or the outflow orifices of the rotor are designed as slots extending in tangential direction. As a result, the opening angles can be kept as large as possible (theoretically 90° in a four-stroke engine) to obtain a lowest possible fuel pressure at full load.

Figure 4B:
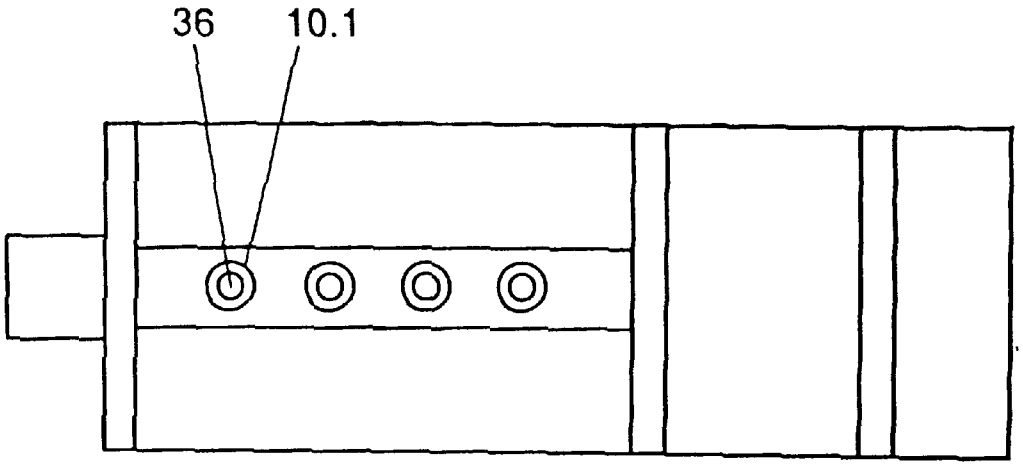
FIGS. 4*a,b* show a front elevation and top plan view of a first embodiment of a distributing device according to FIG. 3 with throughflow orifices in an in-line arrangement.
Figure 4A:
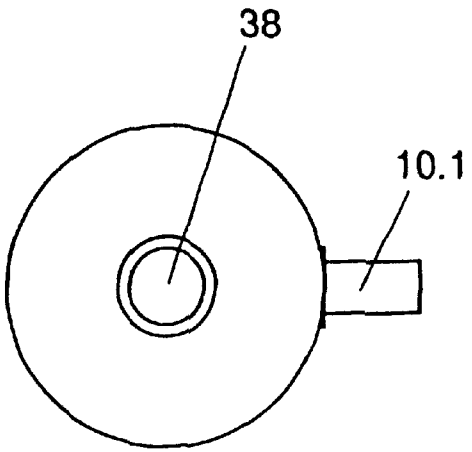
Figure 5B:
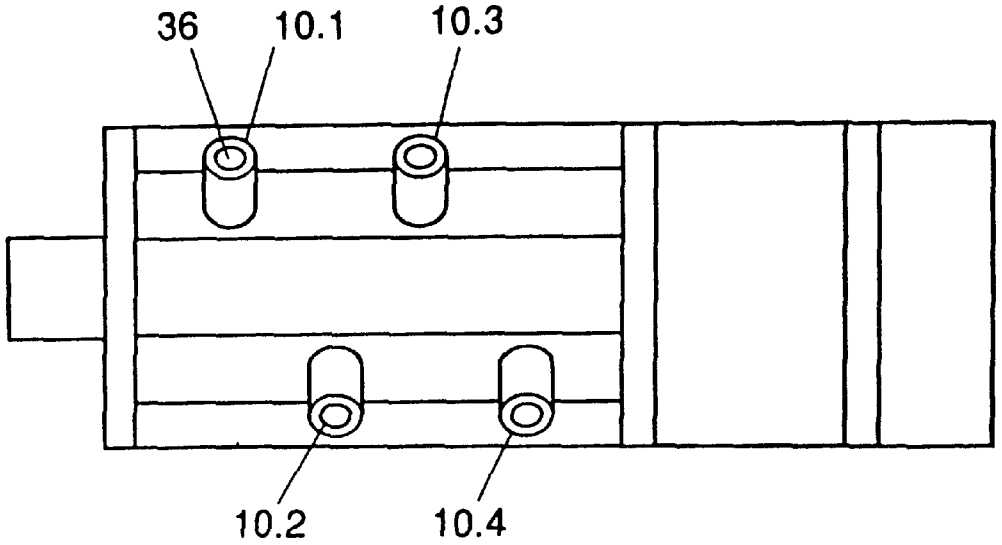
FIGS. 5*a,b* show a front elevation and top plan view of a first embodiment of a distributing device according to FIG. 3 with throughflow orifices in a V-shaped arrangement.
Figure 5A:
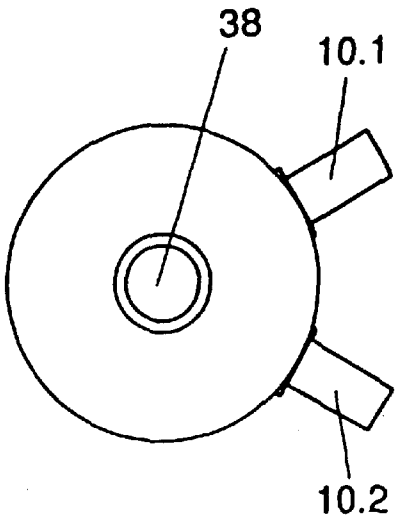

FIGS. 4*a,b* and 5*a,b* respectively show the front and top plan view of two variants for the arrangement of the throughflow orifices 36 and lines 10.i and of the stator 30 for a four-stroke engine. It goes without saying that many other configurations are possible, for instance the star-shaped configuration of throughflow orifices 36 in one plane, with the rotor 32 having only one outflow orifice 34.

Figure 6:
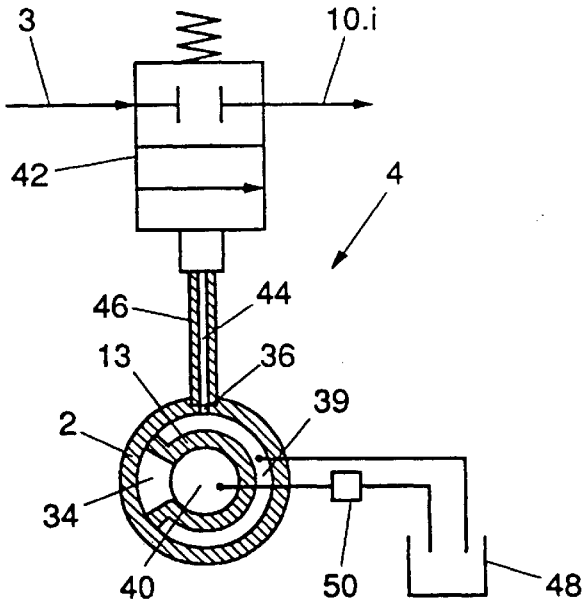
FIG. 6 shows a cross section of a second embodiment of a distributing device suitable for use in the system according to FIG. 2.

FIG. 6 shows a second embodiment of the distributing device 4 according to FIG. 2 which can be used as SFD. FIG. 6 shows only one part of the distributing device 4 which is used for feeding fuel through line 10.1. For the lines 10.2–10.4 a comparable device is employed. In particular, these devices are controlled by one and the same rotor. The rotor 13 shown in FIG. 6 only constitutes a control element, with the fuel being led to, for instance, a 2/2 valve 42, known per se, which valve 42 has two positions and two connections. The rotor 13 can operate the valve 42, for instance, mechanically, electrically, hydraulically, or pneumatically. In the present embodiment, a hydraulic control is provided. The 2/2 valve 42 is here formed by a spring-loaded monostable valve with closed zero position. The 2/2 valve 42 opens as soon as a control fluid 44 flows from the central chamber 40 in the rotor 13 through the outflow orifice 34 into the throughflow orifice 36 of a control line 46 of the 2/2 valve 42. As soon as the control line 46 is connected with a discharge space 39 located between the rotor and the stator, the control fluid 44 can flow back into a reservoir 48 and the 2/2 valve 42 is closed. The control fluid 44 is led to the central chamber 40 of the rotor 13 by, for instance, a pump 50. It will be clear that the opening angle of the 2/2 valve is determined by the size of the outflow orifice 34. In this embodiment, too, the rotor 13 can be driven in different ways and the fuel pressure P is the only control parameter. In addition, other valves, such as for instance a 3/2 valve, can be used.

Figure 7:
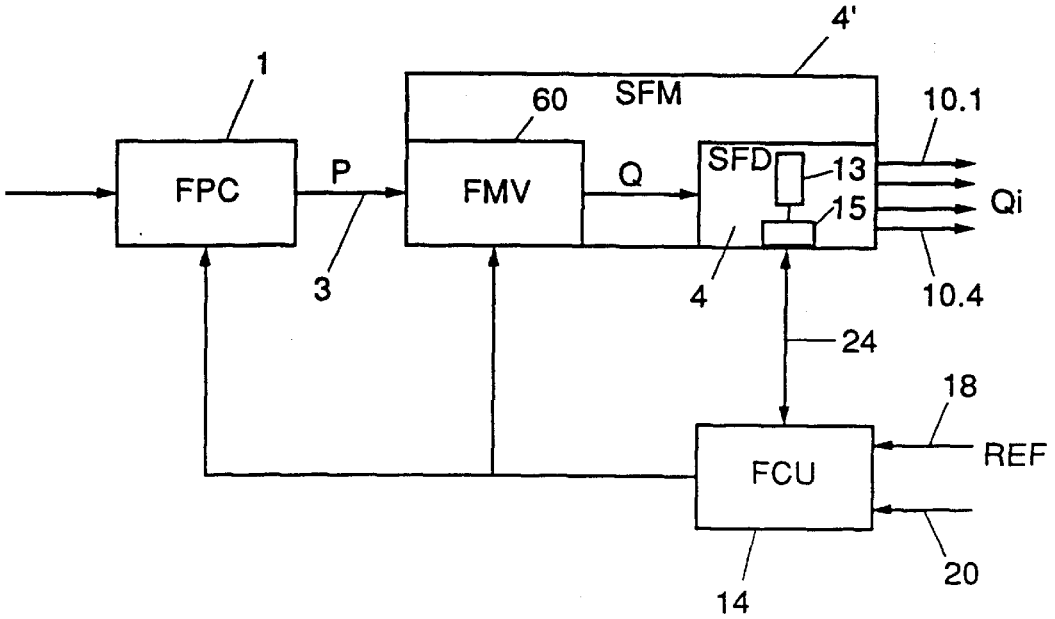
FIG. 7 shows a block diagram of a second particular embodiment of a fuel metering system according to the present invention with a sequentially operating distributing device comprising a flow resistance element.

FIG. 7 shows a second particular embodiment of a fuel metering system according to FIG. 1, in which the system comprises a variable flow resistance 60, hereinafter designated by FMV (Fuel Metering Valve). With the FMV 60 the fuel flow Q that is supplied to the SFD is changed, with the fuel pressure P being variable or constant, depending on the design of the FMV 60. The SFD according to FIG. 7 can for instance be formed by the particular embodiments thereof as discussed in relation to FIGS. 2–6. The FMV 60, too, can be driven mechanically, electrically, hydraulically or pneumatically, and is either controlled by the FCU 14 or, for the purpose of the control, is connected directly with the throttle valve 12 for the combustion air. In the case where the FMV 60 is, for instance, connected directly by means of a Throttle to Throttle Link (TTL), known per se, to the throttle valve 12 according to FIG. 1 and the distributing device 4 is driven mechanically by means of the crankshaft 16, a particularly simple and inexpensive embodiment of a fuel metering system according to the invention is obtained. Of course, it is also possible to control the fuel pressure P by means of the FPC 1 and the fuel flow Q by means of the FMV 60, which provides the advantage of a greater control range (see also FIG. 14).

The flow resistance 60 can also be integrated into distributing device 4'. This form of distributing devices 4' is hereinafter designated by SFM (Sequential Fuel Metering), because the SFM 4' not only distributes the fuel sequentially, as the SFD does, but also meters it.

Figure 8:
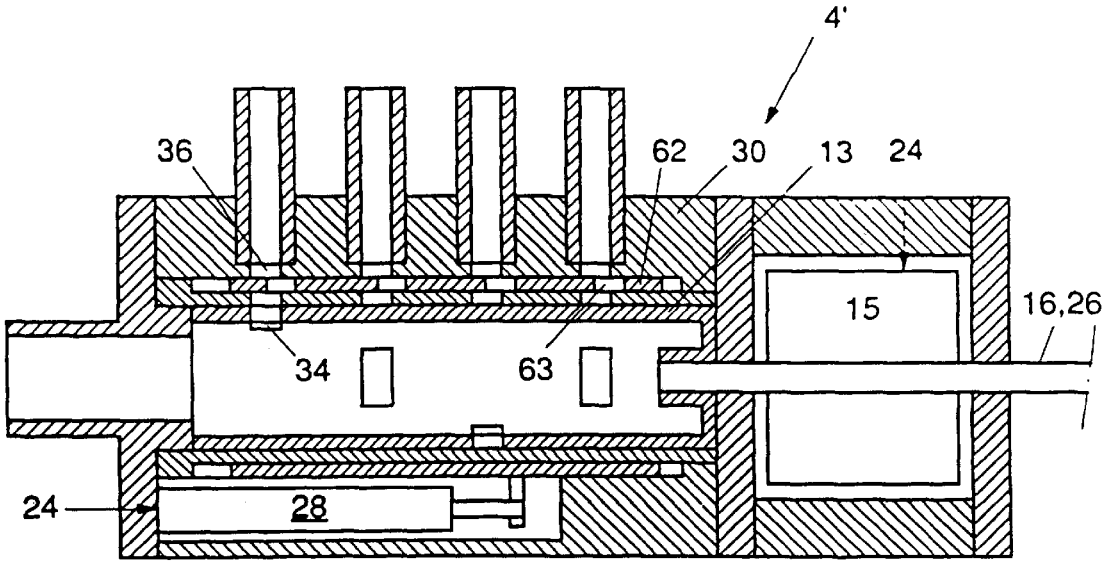
FIG. 8 shows a longitudinal cross section of a third embodiment of a distributing device with a built-in flow resistance element.

FIG. 8 shows a first embodiment of a distributing device 4' which can be used as SFM, in which a shut-off element 62, which is provided with throughflow orifices 63, is arranged in the stator 30 of the distributing device 4' of FIG. 3. The shut-off element 62 is driven by means of an adjusting mechanism, so that the fuel flow Qi between the outflow orifices 34 and the throughflow orifices 36 is adjustable, optionally per individual throughflow orifice 63. The adjusting mechanism 28, as stated, is controlled either by the FCU 14 or by the throttle valve 12. In the latter case, the adjusting mechanism can be connected directly to the throttle valve 12.

The outlets 10.i are, as shown in axial direction, staggered relative to each other. It is also possible, however, as discussed in relation to FIG. 3, that the outlets are in an axial plane and hence assume a star configuration. The variant with the outlets in one axial plane under certain conditions produces an "impure" system from the point of view of measurement and control technique. In fact, if an opening angle of 90 degrees is desired and there are more than four outlets, there is an angular overlap (4×90=360 degrees). That is independent of the manner in which the outlets are arranged (whether or not in one axial plane). However, in the star-shaped construction, all outlets make use of the same rotor orifice. If the angle of the orifice in the rotor is, for instance, 90 degrees, and the angle between the outlets (360/n) is less, then always two or more outlets are simultaneously in communication with the rotor orifice. From the point of view of measurement and control technique, this means that two outlets are communicated with each other, resulting in a Y-shaped circuit of flow resistances: from the supply chamber via a series resistance (rotor) to two parallel resistances (outlets). Both the ratio of the parallel resistances (possibly not entirely equal) and the pressures at the outlets (definitely not constant) then influence the distribution of the flow over the parallel branches. That is undesired. In the design with axially staggered outlets, as shown in FIG. 8, this problem does not arise. True, a flow overlap remains (being imposed by the conditions) but each outlet has its own rotor orifice. So the system consists of a pure parallel circuit of groups of two series resistances (rotor and variable flow resistance). The parallel branches (read: outlets) do not influence each other then.

Figure 9:
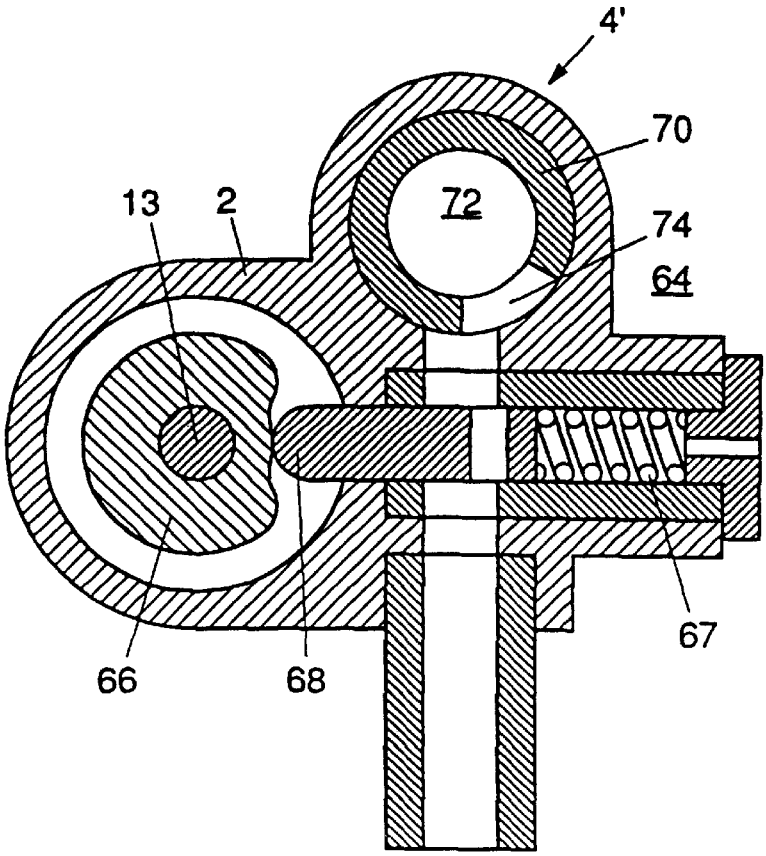
FIG. 9 shows a transverse cross section of a fourth embodiment of a distributing device with a built-in flow resistance element.

FIG. 9 shows a transverse cross section of a second embodiment of a distributing device 4', which can be used as SFM, in which the fuel does not flow through the rotor, but in which the rotor 13 constitutes a control element, in the same manner as the rotor 13 in FIG. 6, which operates a number of valves 64 for the fuel supply to the different cylinders 6. The distributing device 4' in this example is of mechanical design, but it will be clear to those skilled in the art that the valves 64 can also be controlled electrically, hydraulically, or pneumatically. The number of valves 64 corresponds with the number of cylinders 6 of the combustion engine 8. Provided on the rotor 13 are a number of cam discs 66, corresponding in number with the number of cylinders 6, which cooperate with cam followers 68 of the valve 64. Spring elements 67 keep the cam followers 68 pressed against the cam discs 66, so that the cam followers 68 can be displaced linearly through a rotation of the rotor 13 and the cam discs 66. The distributing device 4' also comprises a flow resistance ring 70 functioning as shut-off element. The fuel to be metered and distributed flows via a central supply line 72, located within the resistance ring 70, through an orifice 74 of the flow resistance ring 70, into the valve 64 which, depending on the rotor 13, clears the connection to the cylinder 6 in question.

Figure 10:
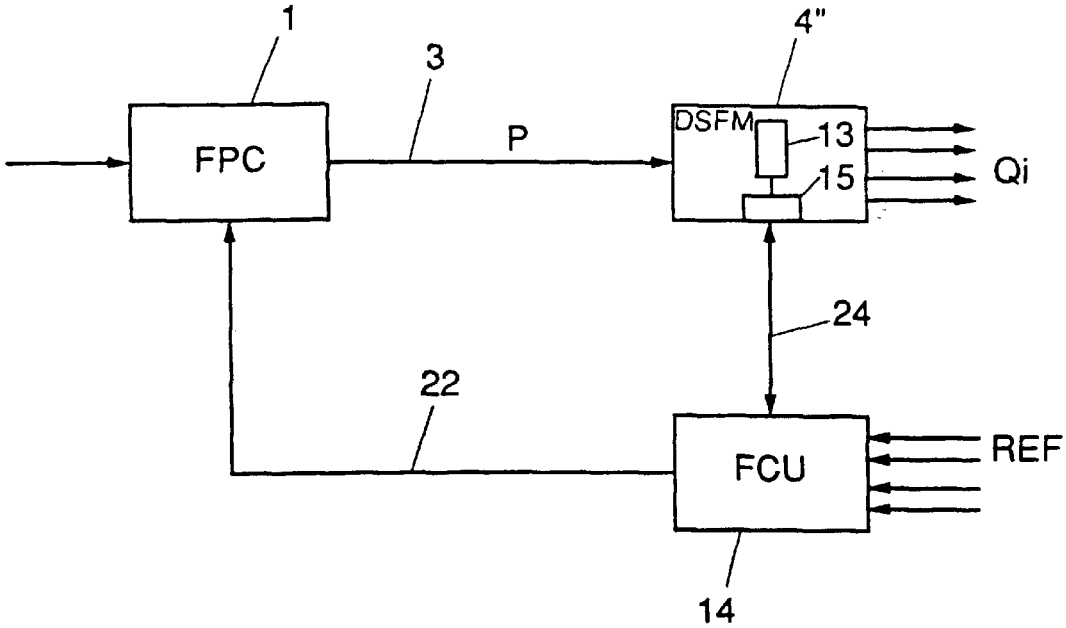
FIG. 10 shows a block diagram of a third particular embodiment of a fuel metering system according to the present invention with a sequentially operating distributing device which is driven dynamically.

Both for the FMV according to FIG. 7 and for the SFM according to FIGS. 9 and 10, it holds that the variation of the passage area with the resistance element is a primary control parameter, i.e. for every load condition of the engine, the FCU sets a particular flow resistance.

FIG. 10 shows a block diagram of a third particular embodiment of a fuel metering system according to FIG. 1, which system comprises a sequentially operating distributing device 4" which is dynamically driven by a servomotor 15 and meters and distributes the fuel depending on the input signals of the FCU 14. However, the rotor can also be driven mechanically, pneumatically, or otherwise. In this dynamically operating distributing device 4", hereinafter designated DSFM 4" (Dynamic Sequential Fuel Metering), the metering function is realized through a dynamic variation of the angle of rotation of the rotor 13, while the mechanical construction of the distributing device 4" can correspond substantially to all of the above-mentioned distributing devices according to FIGS. 3–9. The rotor 13 of the distributing device 4", in contrast with the above-mentioned designs of distributing devices, is not driven in angular synchronism with the crankshaft 16 but instead is successively accelerated and decelerated in its rotary movement. Accordingly, for the variation of the fuel flow, the pulse width is chosen as control parameter. By changing the ratio of the times in which the throughflow orifices 36 are partly opened or closed, the average fuel flow Q can be regulated. It is essential that rotor 13 of the distributing device 4", in any case within the opening phase of the inlet valves (not shown) of the cylinders 6, continues to feed the fuel Qi, so that the sequential character is maintained. Accordingly, it holds again that the angle of rotation of the rotor 13 is a function of the instantaneous angle of rotation of the crankshaft. So, with respect to the crankshaft, the rotor 13 of the DSFM 4" is temporarily set out of phase in a predetermined manner. The block diagram of a fuel metering system according to the DSFM principle in FIG. 10 thus corresponds functionally with the block diagram of FIG. 7.

Figure 11:
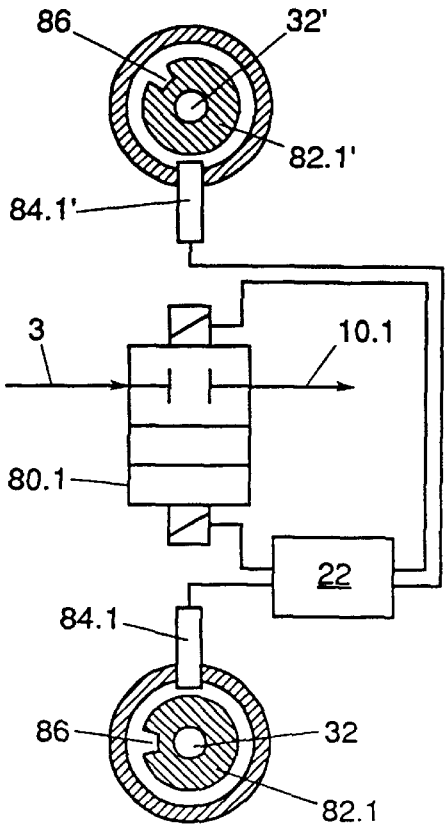
FIG. 11 shows a cross section of a fifth embodiment of a distributing device.

In FIG. 11 an alternative embodiment of a distributing device 4" is shown, which can be used as DSFM 4". Here, for instance a bistable 2/2 valve 80.1, that is, a valve having a stable open position and a stable closed position, is controlled electrically. The device shown in FIG. 11 regulates the fuel metering for line 10.1. For the other lines 10.2–10.4, similar valves 80.2–80.4 (not shown) are used here. For opening and closing the 2/2 valves 80.1–80.4, two rotors 32, 32' are used, on each of which are arranged a number of pulse discs 82.1–82.4, 82.1'–82.4', corresponding in number with the number of 2/2 valves 80.1–80.4. Sensing devices 84.1–84.4, 84.1'–84.4' register one or more recesses 86 in the pulse discs and thereafter set the 2/2 valves 82.1–82.4 in the open or closed position. Because each 2/2 valve 82.1 is connected with two rotors 32, 32' which are controlled via the FCU 14, the arrangement being such that the phase difference between two pulse discs 82.1 and 82i' (i=1, 2, 3, 4 . . . n) is variable, a particularly simple pulse width control can be realized.

Figure 12:
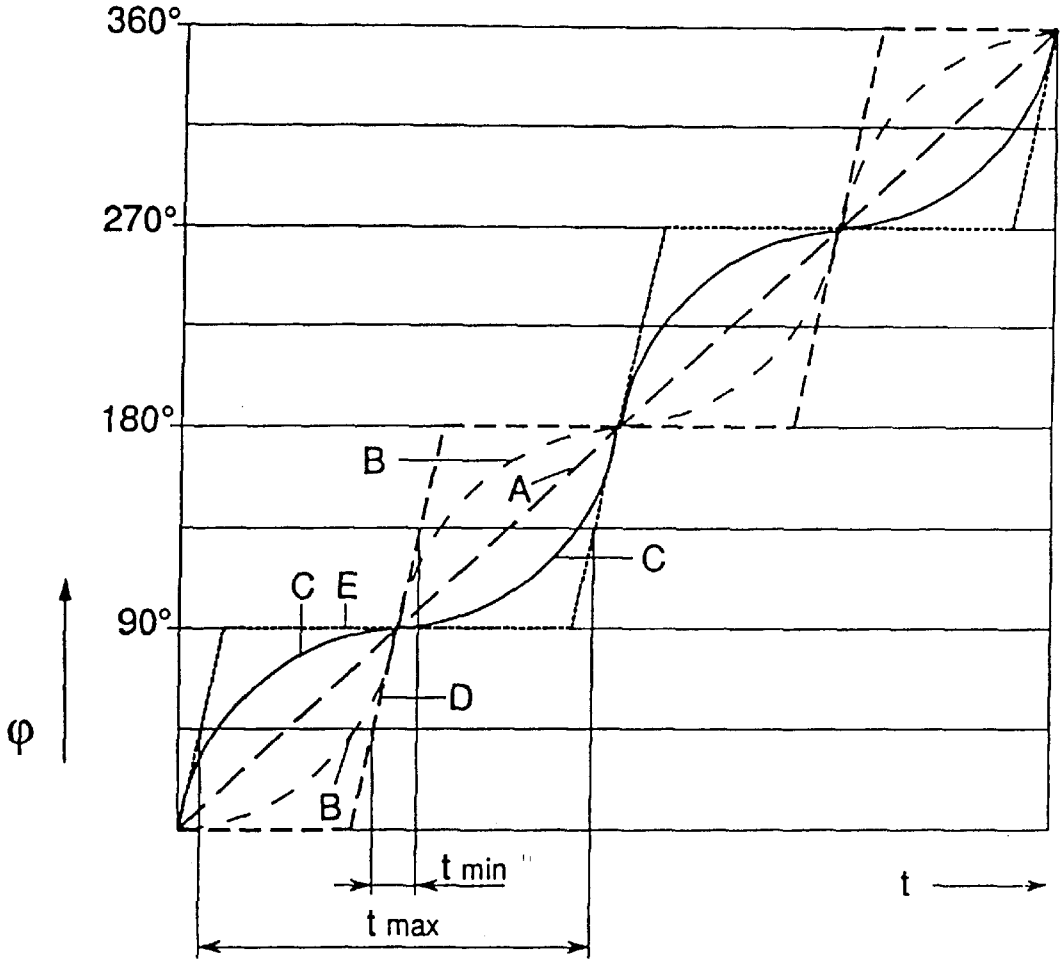
FIG. 12 shows a diagram in which the rotor position is represented as depending on time for a fuel metering system according to FIG. 10.
Figure 13:
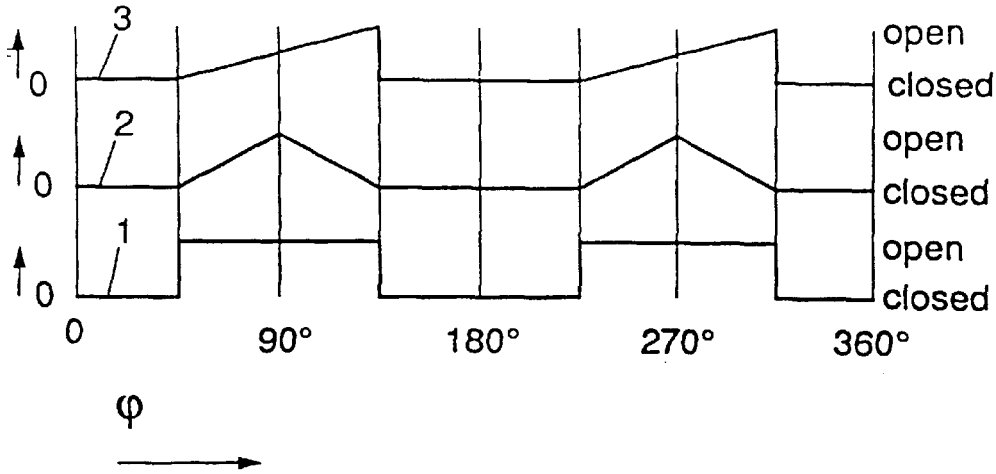
FIG. 13 shows a diagram in which different throughflow surfaces are represented as a function of the rotor position, for a fuel metering system according to FIG. 10.

The graphs in FIGS. 12 and 13 show the dynamic drive of the DSFM 4". For the sake of simplicity, here graphs for a twin-cylinder engine are shown. In FIG. 12, the truly angle-synchronous course is described by line A. Here, for instance the supply to a first cylinder 6 is opened at an angle of rotation (ϕ) of 45° and subsequently closed at an angle of rotation (ϕ) of 135°. A shorter open time arises by traversing the open position of the distributing device (DSFM) 4" faster (line B). A longer open time arises by traversing the open position of the distributing device 4" more slowly (line C). The minimum open time $t_{min}$ arises by traversing the open position of the distributing device 4" at maximum speed (line D) and a maximum open time $t_{max}$ is achieved by traversing the closed position at maximum speed (line E). It will be clear that the open time of the distributing device 4" can be adjusted between these limits by the FCU 14. Here, too, the rotor is temporarily driven continuously. 'Continuous drive' is here understood explicitly to refer also to the continuous drive of the rotor which can be stopped temporarily. However, at the time when the rotor rotates, this will always be a continuous, i.e. not discontinuous, rotary movement.

A second control parameter is available when the opening characteristic of the DSFM 4" is given a course other than a purely maximally open/fully closed character. The distributing device then comprises at least one throughflow orifice through which the fuel flows, with the area (O) of the throughflow orifice being a function of the angle of rotation of the rotor 13. This can be effected, for instance, by adjusting the shape of the outflow orifice 34 and/or the inflow orifice 36 in the distributing device according to FIG. 3. FIG. 13 shows three possible opening characteristics which can thus be realized. Area diagram 1 is the idealized open/closed characteristic. Further, as examples, a symmetrical triangle (diagram 2) and a saw tooth (diagram 3) are shown, where the saw tooth with optionally flat and/or less variable inclinations seems most suitable for this application. To increase the control range of the DSFM, in addition the fuel pressure P can be controlled by the FCU 14 via the FPC 1, which, however, is not necessary.

Figure 14:
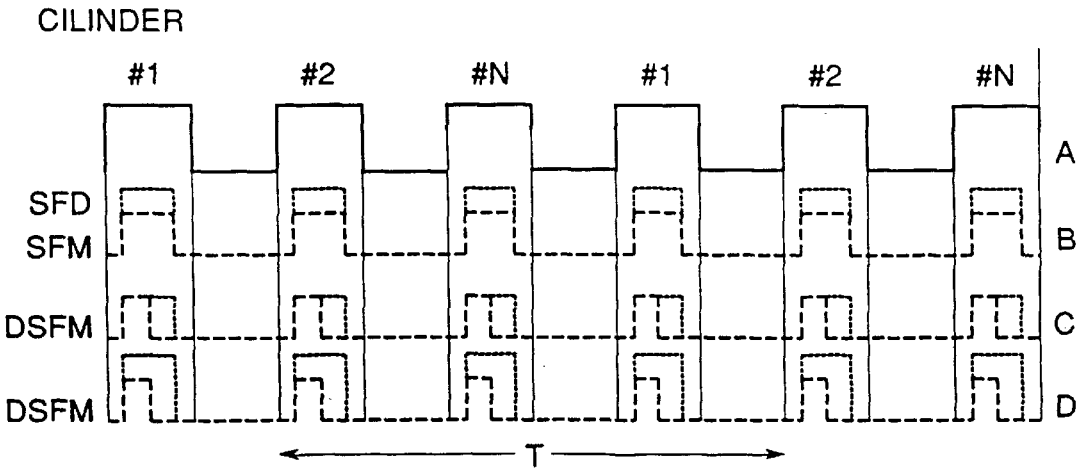
FIG. 14 shows a diagram in which the open and closed characteristics are represented as depending on time, for the different fuel metering systems according to FIGS. 1–11.

In illustration of the embodiments mentioned, FIG. 14 depicts the idealized time diagrams of the quantity of fuel supplied to the engine 8 according to the above-discussed different fuel metering systems. A high fuel supply is denoted by a dotted line and a comparatively lower fuel supply is denoted by a broken line. Shown at A is the maximum pulse width, limited by the opening angle of the inlet valve, in which fuel can be supplied to a cylinder N, with the engine speed following from a period T as shown in FIG. 14. The ratio of the open and closed times of the inlet valves of the cylinders is fixed and is determined by the crankshaft. The duration of the open and closed times depends inversely proportionally on the engine speed. B shows the fuel pulse diagram of the SFD and SFM. The ratio between open and closed times of the SFD/SFM is constant, because no pulse width change is possible and because it is independent of the period T. The height of the fuel pulses, that is, the quantity of fuel supplied to the cylinders, is dependent on the engine load. In the SFD, it is set by means of the FPC and/or the FMV and in the SFM by means of the integrated flow resistance element, whether or not in combination with the FPC. C and D show characteristics of the DSFM, where in diagram C the fuel is supplied to the DSFM at a constant pressure and in D the control range is increased in that the fuel pressure can be varied. The ratio of the open and closed times, however, is not constant in either case. Depending on the quantity of fuel to be delivered, the open time of the DSFM is set. From the period T then follows the resultant closed time.

The invention is not in any way limited to the embodiments described hereinabove. For instance, it is also possible to include a variable flow resistance element for each cylinder in the system, so that it is possible to control the magnitude of the fuel flow per cylinder. Then in each line 10.i (i=1, 2, . . . ) for instance an FMV 60 can be included. In addition, it is for instance possible that a distributing device with more than one outflow orifice per cylinder is chosen. In that case, there are, for instance, eight lines 10.i (i=1, 2, . . . 8) which in pairs of two lead to four cylinders respectively.

It is also possible to obtain a pulse width control with two rotor/stator combinations. Here, a first and a second rotor/stator combination according to one of the types described above, in, for instance, FIG. 3 and/or FIG. 8, are connected in series. The first and the second stator combination have a variable phase difference, the arrangement being such that the second rotor/stator combination closes a passage to the cylinders before the first rotor/stator combination does so. Then, of course, it is necessary that the second rotor/stator combination, arranged downstream of the first rotor/stator combination, has n-inlets (instead of one) and n-outlets, because branches downstream of the first rotor/stator combination must remain separate. A similar system can be realized in accordance with the invention with one stator and two rotors rotating around each other.

According to other variants of the invention, a tangentially and/or axially adjustable flow resistance element is mounted on or in the rotor and in or adjacent the cylinder instead of in the stator.

Further, it will be clear that the system according to the invention can be used for an engine with a random number of cylinders. These and other readily conceivable variants are all understood to fall within the scope of the invention.

I claim:

1. A fuel metering system for feeding fuel from a storage tank to the cylinders of a combustion engine, comprising a fuel supply unit and a distributing device comprising at least one rotor, with the fuel supply unit continuously feeding fuel from the storage tank to the distributing device, and with the distributing device, depending on the angle of rotation of the rotor, feeding fuel to the cylinders of the combustion engine while determining for each cylinder during what period fuel is injected at this cylinder, characterized in that the fuel metering system comprises drive means for driving the rotor in a continuously rotating manner, with the angle of rotation of the rotor being a continuous function of the instantaneous angle of rotation of a crankshaft or camshaft of the combustion engine, and with the distributing device continuously sequentially feeding fuel into the cylinder of the combustion engine, wherein the fuel metering system further comprises a control unit (FCU) to which engine parameters such as engine load and/or rotary movement of the crankshaft or camshaft are supplied, and the control unit (FCU) controls the rotary movement of the rotor depending on the engine parameters.

2. A fuel metering system for feeding fuel from a storage tank to the cylinders of a combustion engine, comprising a fuel supply unit and a distributing device comprising at least one rotor, with the fuel supply unit continuously feeding fuel from the storage tank to the distributing device, and with the distributing device, depending on the angle of rotation of the rotor, feeding fuel to the cylinders of the combustion engine while determining for each cylinder during what period fuel is injected at this cylinder, characterized in that the fuel metering system comprises drive means for driving the rotor in a continuously rotating manner, with the angle of rotation of the rotor being a continuous function of the instantaneous angle of rotation of a crankshaft or camshaft of the combustion engine, and with the distributing device continuously sequentially feeding fuel into the cylinder of the combustion engine, wherein the distributing device further comprises at least one fuel supply valve of which an inlet is connected with the fuel supply unit and of which an outlet is connected with at least one of the cylinders of the engine, as well as means for opening and/or closing the fuel supply valve depending on the angle of rotation of the rotor.

3. A fuel metering system according to claim 2, characterized in that the fuel supply valve is of the monostable type, with the valve comprising a stable and an unstable condition, wherein the valve is closed or opened, respectively, with the rotor bringing the valve from the stable condition into the unstable condition for opening or closing the valve.

4. A fuel metering system according to claim 2, characterized in that the valve comprises two conditions wherein the valve is opened or closed, respectively, the distributing device comprising a first and a second rotor and means for opening the valve depending on the angle of rotation of the first rotor and for closing the valve depending on the angle of rotation of the second rotor.

5. A fuel metering system for feeding fuel from a storage tank to the cylinders of a combustion engine, comprising a fuel supply unit and a distributing device comprising at least one rotor, with the fuel supply unit continuously feeding fuel from the storage tank to the distributing device, and with the distributing device, depending on the angle of rotation of the rotor, feeding fuel to the cylinders of the combustion engine while determining for each cylinder during what period fuel is injected at this cylinder, characterized in that the fuel metering system comprises drive means for driving the rotor in a continuously rotating manner, with the angle of rotation of the rotor being a continuous function of the instantaneous angle of rotation of a crankshaft or camshaft of the combustion engine, and with the distributing device continuously sequentially feeding fuel into the cylinder of the combustion engine, wherein the system further comprises means for accelerating and decelerating the rotary movement of the rotor relative to the rotary movement of the crankshaft or camshaft for varying the opening angles in which fuel is fed into the cylinders.

6. A fuel metering system according to claim 5, which further comprises means for varying the phase difference between the first and second rotor for varying an open angle in which fuel is fed to a cylinder.

7. A fuel metering system according to claim 1, characterized in that said means comprise the control unit.

8. A fuel metering system for feeding fuel from a storage tank to the cylinders of a combustion engine comprising a crankshaft and possibly a camshaft, the fuel metering system comprising a fuel supply unit and a distributing device comprising a stator, having a plurality of throughflow orifices, and a rotor, having a supply orifice for the fuel and a plurality of outflow orifices, wherein the outflow orifices of the rotor are sequentially brought into throughflow communication with the throughflow orifices of the stator through rotation of the rotor relative to the stator along an opening angle for determining at what cylinder fuel is injected and for determining during what angle of rotation of the crankshaft and/or camshaft fuel is injected, the distributing device further comprising drive means for driving the rotor in a continuously rotating manner with the angle of rotation of the rotor being a continuous function of the instantaneous angle of rotation of the crankshaft or camshaft such that each change of the angle of rotation of the crankshaft or camshaft corresponds with a change of the angle of rotation of the rotor so that the rotor is driven in angular synchronism with the crankshaft, with the fuel supply unit continuously feeding fuel from the storage tank to the distributing device, wherein the throughflow orifices of the stator are in axial direction, staggered relative to each other and wherein the throughflow orifices of the stator or the outflow orifices of the rotor are designed as slots extending in tangential direction so that the opening angles can be kept as large as possible.

9. A fuel metering system according to claim 8, characterized in that in use, within the opening angle of an inlet valve of each cylinder, fuel flows through the distributing device to the relevant cylinder.

10. A fuel metering system according to claim 8, characterized in that the system further comprises at least one controllable flow resistance element, located downstream of the fuel supply unit, for controlling the magnitude of the fuel flow to the cylinders.

11. A fuel metering system according to claim 10, characterized in that the at least one controllable flow resistance element forms part of the distributing device.

12. A fuel metering system according to claim 8, characterized in that the system further comprises a control unit (FCU) to which engine parameters such as for instance the engine load and/or the rotary movement of the crankshaft or camshaft are supplied.

13. A fuel metering system according to claim 12, characterized in that the control unit (FCU) controls the at least one flow resistance element depending on the engine parameters.

14. A fuel metering system according to claim 8, characterized in that the rotor comprises a cylindrical hollow body which comprises said supply orifice and one cylinder wall of which comprises the outflow orifice, and fuel can be introduced via the supply orifice into the cylindrical hollow body of the rotor; and that the stator comprises a cylindrical hollow body, in which the rotor is situated, a cylinder wall of the rotor comprising a number of throughflow orifices each in fluid communication with at least one of the cylinders of the engine.

15. A fuel metering system according to claim 11, characterized in that the at least one flow resistance element comprises a control element for varying the magnitude of a passage in the flow of the fuel through the distributing device.

16. A fuel metering system according to claim 8, characterized in that the drive means connect the rotor mechanically with the crankshaft or camshaft of the engine.

17. A fuel metering system according to claim 10, characterized in that at least one controllable resistance element in the combustion air inlet system of the engine controls the at least one flow resistance element.

18. A fuel metering system according to claim 8, characterized in that the distributing device comprises at least one throughflow orifice through which the fuel flows and the effective magnitude of which is a function of the angle of rotation of the rotor.

* * * * *

UNITED STATES PATENT AND TRADEMARK OFFICE
CERTIFICATE OF CORRECTION

PATENT NO. : 5,924,408

DATED : July 20, 1999

INVENTOR(S) : A. van den Wildenberg

It is certified that error appears in the above-identified patent and that said Letters Patent is hereby corrected as shown below:

On the title page at [30] Foreign Application Priority Data: change the priority application no. from "940187" to --9401807--.

Signed and Sealed this

Thirtieth Day of November, 1999

*Attest:*

*Attesting Officer*

Q. TODD DICKINSON

*Acting Commissioner of Patents and Trademarks*